United States Patent [19]

Cotugno

[11] 4,087,021

[45] May 2, 1978

[54] GAME CHIP DISPENSER WITH MARKER

[76] Inventor: Julia Cotugno, 217F Cottrell Rd., Matawan, N.J. 07747

[21] Appl. No.: 761,393

[22] Filed: Jan. 21, 1977

[51] Int. Cl.[2] ..... B43K 29/20; G07D 9/00

[52] U.S. Cl. ..... 221/199; 221/312 A; 401/195

[58] Field of Search ..... 401/195, 198; 221/199, 221/307, 310, 312 A

[56] References Cited

U.S. PATENT DOCUMENTS

| | | | |
|---|---|---|---|
| 536,445 | 3/1895 | Rockwell | 221/312 A |
| 1,800,459 | 4/1931 | Maclean | 221/312 A |
| 1,890,388 | 12/1932 | Kramlik | 221/310 X |
| 2,841,809 | 7/1958 | Oliver | 221/312 A |
| 2,865,533 | 12/1958 | Taylor | 221/199 |
| 3,228,555 | 1/1966 | Pinto | 221/199 |
| 3,436,163 | 4/1969 | Calabrese et al. | 401/195 |
| 3,639,069 | 2/1972 | Gordon | 401/195 |

*Primary Examiner*—Robert B. Reeves

*Assistant Examiner*—David A. Scherbel

*Attorney, Agent, or Firm*—Stanley W. Sokolowski

[57] ABSTRACT

The invention, in the embodiment depicted by way of example only, comprises an elongate rod which serves as a cartridge or carrier for a plurality of game-play chips. The chips are centrally apertured and are slidably engaged with the outer surface of the rod. A detent arrangement, fixed within the dispensing end of the rod selectively allows single chips, in turn, to be dispensed upon the supply of chips being slidably urged against the detent arrangement. In addition, the rod is hollow; the same defines a storage chamber or carrier for a marking pen. The hollow interior of the rod opens onto the end thereof which is opposite the dispensing end, and a marking pen frictionally engaged within the rod has the marker end projecting therefrom. A closure cap is received on the opposite end of the rod to protect the marker end of the pen when the latter is not in use. Too, the cap has an annular flange extending therefrom which serves as a retainer for the game-play chips.

3 Claims, 3 Drawing Figures

GAME CHIP DISPENSER WITH MARKER

BACKGROUND OF THE INVENTION

1. Field of the Invention

This invention pertains to dispensers, and in particular to dispenser means defined especially for use in selectively dispensing game-play chips and the like.

2. Description of the Prior Art

In the course of play of games such as Bingo, poker, etc., there is a need to handle "chips" quickly; especially there is a need to be able to feed out or count out single chips, or the like, quickly and with a sure control of the number thereof being fed out or counted out. Ordinarily, taking the game of Bingo, as an example, game-play chips are dispensed by hand. That is, the player monitors his or her card(s) and, attending to the call-out of letter-number sequences, deposits chips on the play cards by feeding out the chips from a handclenched supply thereof through the dexterity and manipulation of the thumb and forefinger. However, most Bingo devotees are elder persons who, for having a diminished digital dexterity, are somewhat disadvantaged in the game play. What has been needed is a simple and efficient dispenser for game-play chips which does not rely on digital dexterity — a dispenser, moreover, which can supply more chips than can be stored in a closed hand.

In the play of Bingo, too, it is commonly a practice to use a marking pen, rather than chips, to "cover" play-card(s) letter-number indicia. Accordingly, there has been a need, as yet unmet, for a device which will satisfy both the above-noted need for a simple and efficient dispenser and the concomitant requirement for a marking pen.

SUMMARY OF THE INVENTION

It is an object of this invention to meet both needs. Particularly, it is an object of this invention to set forth dispenser means, for game-play chips and the like, comprising means for receiving a plurality of game-play chips in slidable engagement therewith; said receiving means comprising an elongate element having a termination at one end thereof which defines a dispensing end; and first means coupled to said one end of said element, and second means coupled to the opposite end of said element, for retaining game-play chips in engagement with said element; wherein at least one of said first and second means has means yieldably reponsive to pressure applied thereto for releasing game-play chips from engagement with said element.

It is another object of this invention to set forth dispenser means of the type above-noted in which said elongate element is hollow, having a storage chamber formed therewithin, and including marking means slidably and replaceably carried carried within said chamber.

BRIEF DESCRIPTION OF THE DRAWINGS

Further objects of this invention, as well as the novel features thereof, will become more apparent by reference to the following description taken in conjunction with the accompanying Figures, in which:

FIG. 3 is of the same enlarged scale as is FIG. 2.

DESCRIPTION OF THE PREFERRED EMBODIMENT

Figure 1:
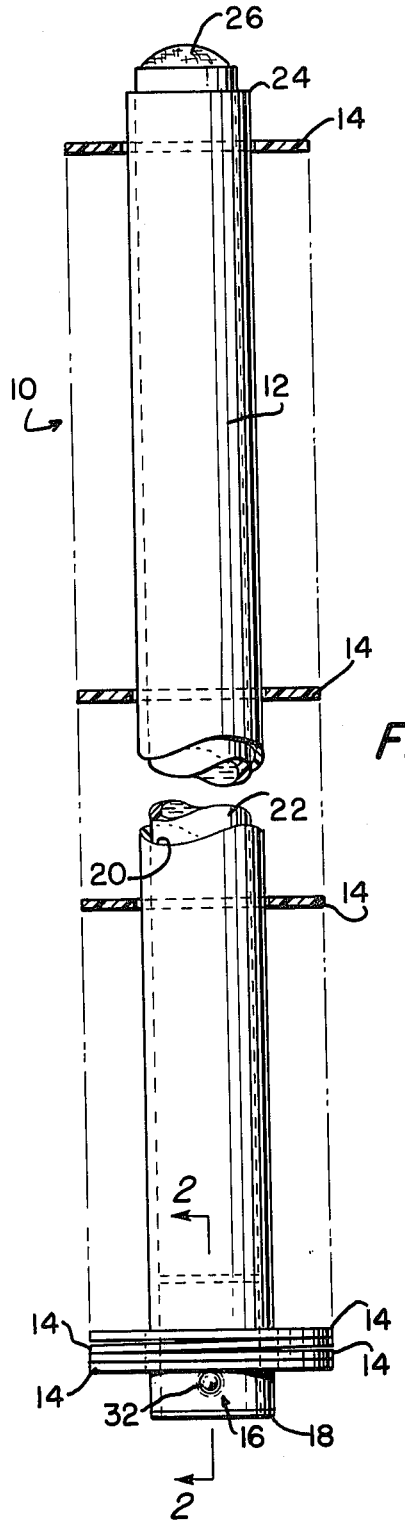
FIG. 1 is a discontinuous, longitudinal view, of an embodiment of a dispenser means according to the invention, in which slidably received chips thereon are shown in cross-section.

As shown in the Figures, which depict only one embodiment which the invention may take, the dispensing means 10 comprises an elongate rod 12 on the outer surface of which a plurality of game-play chips 14 are slidably engaged. A detent arrangement 16 carried in the dispensing end 18 of the rod 12, retains and selectively releases the chips 14 from end 18. Rod 12 is hollow, having a chamber 20 formed therewithin in which a marking pen 22 is frictionally engaged. Chamber 20 opens onto the opposite end 24 of the rod 12 and, from end 24, a marker end 26 of the pen 22 projects. Marker end 26 comprises a fiber tip. However, this is arbitrary, Pen 22 could just as well be a ball-point pen, or could be supplanted with a graphite-lead pencil, or equivalent, each being replaceable.

Figure 2:
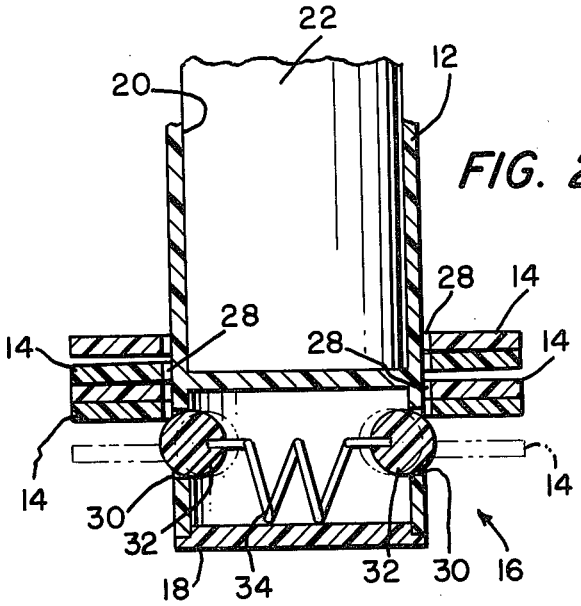
FIG. 2 is a cross-sectional view, taken along 2—2 of FIG. 1 the same being enlarged over the scale of FIG. 1 to show the exemplary detent arrangement.

FIG. 2 illustrates the detent arrangement 16 in more detail, as well as the chips 14. As depicted, the chips 14 have central apertures 28 of a given dimension which accommodates a freely slidable relationship of the chips on the outer surface of the rod 12. Now, the detent arrangement 16 comprises a pair of opposed boreholes 30 formed through the dispensing end 18 of the rod. A pair of spheres 32 are resiliently held in the boreholes under the urging of a doublecoiled spring 34. The spheres 32 have a diameter slightly greater than that of the boreholes; hence, they cannot pass through. Yet, the spheres 32 offer sufficient obstruction to the supply of chips 14 to prevent the latter from freely discharging from the rod 12. In order to dispense a chip 14, it is only necessary to apply pressure, i.e.: down-feed the chips 14, and a foremost chip will overcome the bias of the spring 34, cause the spheres 32 to retract within the boreholes 30, and allow the aperture 28 to pass thereover.

Figure 3:
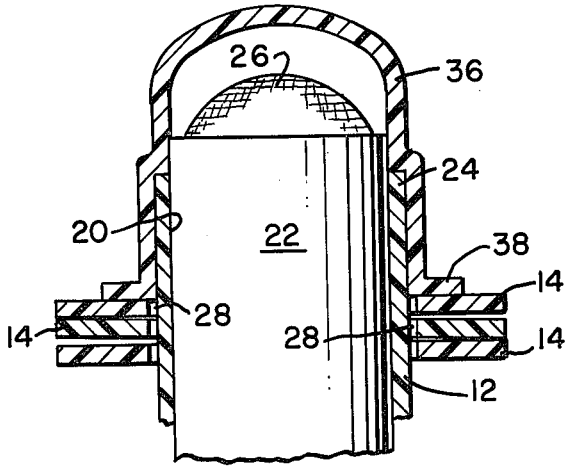
FIG. 3 is a cross-sectional view of the opposite end of the novel dispenser means embodiment of FIG. 1 to which the closure cap has been added.

The opposite end 24 of the rod 12 receives an end closure cap 36, as shown in FIG. 3, shieldably to protect the marker end 26 of the pen 22. The cap 36 forms an interference fit with end 24, and is left in place whenever the pen 22 is not being used in game play. Additionally, however, cap 36 has an integral flange 38 formed therewith which serves as a retainer for the supply of chips 14 carried on the rod 12.

As noted earlier, it remains only to apply a downward pressure on the supply of chips 14 to dispense the latter, singly, from the dispensing end 18 of the rod 12. This may be done either by holding the rod and thereabout supply of chips 14 in the closed hand, and addressing the play card onto which the chips are to be dispensed by bringing down the heel of the hand — with rod end 18 projecting therefrom, or by holding the rod and supply of chips like a pencil.

The detent arrangement depicted is only exemplary, Other arrangements, in which a single, side-disposed, resiliently biased sphere may be deployed, or where a spring — like spring 34 — disposes formed "detents" through the boreholes 30, are feasible. Accordingly, such alternative arrangements and/or embodiments proceed from the teaching of my invention and are deemed to be within the ambit thereof. For instance, if warranted, it will be possible to provide a game-play chips dispensing rod in which, in lieu of the marking pen 22, the chips — like chips 14 — are slidably received and stored within. In this, then, the detenting arrangement would be outwardly carried to intrude the detents thereof within the chamber 20. Thus, while I have described my invention in connection with a specific embodiment thereof, it is to be clearly understood that this is done only by way of example and not as a limitation to the scope of my invention as set forth in the objects thereof and in the appended claims.

I claim:

1. Dispenser means, for game-play chips and the like, comprising:

means for receiving a plurality of game-play chips in slidable engagement therewith;

said receiving means comprising an elongate element having a termination at one end thereof which defines a dispensing end; and first means coupled to said one end of said element, and second means coupled to the opposite end of said element, for retaining game-play chips in engagement with said element; wherein at least one of said first and second means has means yieldably responsive to pressure applied thereto for releasing game-play chips from engagement with said element;

said element has an external, elongate surface disposed for defining therealong a relatively slidable interface with game-play chips;

said first and second means each comprises means projecting from said surface for obstructing thereat game-play chips slidably-interfaced movement relative to said surface;

one of said first and second means further comprises an end cap;

said cap having means effecting a releasable interference fit of said cap with said opposite end of said element;

said cap further has an annular flange which defines said projecting means thereof; and said element is hollow, having a storage chamber formed therewithin in which slidably to carry a marking means; further including marking means slidably and replaceably carried within said chamber; wherein said chamber opens onto said opposite end of said element; said marking means includes a marker on one end thereof;

said marker projects from said opposite end of said element;

said cap comprises a cup-shaped element for shieldably protecting said marker therewithin; and said marking means and said chamber have mutually engaging surfaces which define therebetween a frictionally-releasable engagement.

2. Dispenser means, according to claim 1, wherein:

at least one of said first and second means comprises detent means.

3. Dispenser means, according to claim 2, wherein:

said detent means includes a resiliently-biased component which defines said projecting means, and further includes means which accommodates a withdrawal of said component from said surface upon pressure being applied to said component.

* * * * *